United States Patent [19]

Thompson

[11] 4,349,933

[45] Sep. 21, 1982

[54] CURLING PUSH-BROOM

[76] Inventor: Albert N. Thompson, 539 Almey Ave., Winnipeg, Man., Canada, R2C 2Z2

[21] Appl. No.: 231,306

[22] Filed: Feb. 4, 1981

[30] Foreign Application Priority Data

Feb. 11, 1980 [CA] Canada ..... 345392

[51] Int. Cl.[3] ..... A63B 67/14

[52] U.S. Cl. ..... 15/118; 15/210 R; 15/228

[58] Field of Search ..... 15/106, 114, 118, 160, 15/208, 209 R, 210 R, 228, 229 R, 229 A

[56] References Cited

U.S. PATENT DOCUMENTS

| | | | |
|---|---|---|---|
| 3,412,418 | 11/1968 | Griffin | 15/229 |
| 3,469,274 | 9/1969 | Snapp | 15/228 |
| 3,713,744 | 1/1973 | Sims | 15/210 R |

FOREIGN PATENT DOCUMENTS

| | | |
|---|---|---|
| 583957 | 9/1959 | Canada . |
| 1052577 | 4/1979 | Canada . |
| 1378638 | 12/1974 | United Kingdom . |

*Primary Examiner*—Edward L. Roberts

*Attorney, Agent, or Firm*—Cushman, Darby & Cushman

[57] ABSTRACT

A curling broom of the push-broom type has the active bottom surface provided with a fabric coating replacing the usual natural or artificial bristles. Preferably, two types of fabric are applied one beside the other, differing from each other in coarseness. The generally flat active surfaces of the fabrics are vertically spaced from each other and one of the surfaces is preferably inclined relative to the other whereby a selective combination of polishing and buffing action can be achieved by simply tilting the handle of the broom. The invention improves the action of the broom, reduces the manufacturing costs, virtually eliminates some contamination of the ice surface and greatly extends operation life of the device. A separate, detachable plate for use in the broom is also disclosed.

16 Claims, 5 Drawing Figures

CURLING PUSH-BROOM

BACKGROUND OF THE INVENTION

The present invention relates to the art of curling brooms and in particular to so-called push brooms, sometimes also referred to as curling brushes.

For many years, the only type of broom used in the game of curling was a sweeping broom and many different embodiments of such sweeping brooms have been introduced in the market.

Approximately three years ago, some curlers began using, with considerable success, so-called push brooms or curling brushes, generally of the type well known from the art of cleaning. In general, the push broom is typical by a solid, rigid block, usually of rectangular plan, from whose top surface protrudes a handle at an angle and whose bottom is provided with bristles for polishing the ice. The reason for recent success of curling brushes is mainly seen in that the curling brushes provide more subtle control of the sweeping or polishing action, as may be required during the game of curling.

The known curling push brooms or brushes have always used bristles, either synthetic (usually nylon) or natural (horse hair or pig bristles). The bristles of push brooms are of substantially different physical characteristics from corn bristles normally used in the sweeping brooms of the type. The bristles of a push broom must be considerably more rigid than corn bristles used in sweeping brooms. If a corn bristle from a sweeping broom is left on ice during the sweeping action, the corn debris poses undesired obstacles for the smooth sliding of curling rocks. The problem of contaminating the ice sheet surface has become considerably more substantial with the advent of the push brooms. It was found out that the bristles normally used in push brooms, if left on ice as a debris, have a considerably more undesired effect. It has been observed that a push broom bristle contaminating the surface of ice, when encountered by a sliding rock, considerably changes the direction of travel of the rock. Unlike the corn debris, the debris of particles of push broom bristles has a tendency of embedding itself into the ice surface when encountered by a rock. As a result, it is not uncommon that the debris completely changes the direction of movement of the sliding rock or, in many instances, simply stops the sliding motion of the rock within a few feet. On the other hand, due to the improved fineness of control of the sweeping action when using the curling brush, the curling brushes continue to be an increasingly popular substitute for the classical sweeping broom.

An object of the present invention is not only to avoid the above drawbacks of curling push brooms but also to further improve the efficiency thereof by rendering the broom more versatile for different purposes. Another object of the present invention is to increase the operation life of a curling push broom. Another object of the present invention is to facilitate the production of such push broom and to thus reduce the cost thereof. Still another object of the invention is to provide a curling push broom which, apart from relatively inexpensive production, has an aesthetically pleasing appearance.

SUMMARY OF THE INVENTION

In one aspect, the present invention provides, for use in a curling push broom, a base plate comprising a bottom surface and a top surface; a fabric covering fixedly secured to the bottom surface; means for securing said base plate to handle means with said bottom surface being turned away from the handle means; whereby the fabric means forms active surface of a broom for polishing or buffing the ice in the game of curling. Preferably, the fabric is an nylon fabric and it is most preferred that the fabric be a deep-pile carpet-type nylon fabric. This type of fabric has been found to be extremely effective in polishing ice to a degree that cannot be achieved by other types of brooms.

The fabric may also be comprised of a non-woven reversed needle point polypropylene fabric, whereby the broom utilizing the base plate is effective in ice buffing.

In a most preferred embodiment, the bottom surface comprises a first area whose outside margin is coincident with a first end and with a part of each of two opposite sides of said bottom surface; a second area whose outside margin is coincident with a second end opposite to said first end and with remaining parts of each of said two opposite sides of said bottom surface; said first area being covered by a first fabric, said second area being covered by a second fabric whose coarseness is different from that of said first fabric; whereby a broom utilizing the base plate can be selectively applied for polishing and/or buffing the ice.

The combination of a deep-pile nylon fabric used in carpeting with a non-woven polypropylene fabric is preferred. In such arrangement, the nylon fabric is used for polishing while the polypropylene fabric is effective in buffing the ice, depending on the instant need of the curler.

According to a further feature of the invention, the first area is a generally planar area coincident with a first plane; said second area being also generally planar and coincident with a second plane, said first and second planes being slightly inclined relative to each other and intersecting each other along a line extending from one of said two opposite sides of the plate to the other, said second plane being inclined forwardly and upwardly from said bottom surface.

The above basic features of the present invention can also be defined, in general terms, as a curling push-broom of the type including an elongate block having a generally flat, normally horizontal bottom surface to which an active means for ice polishing and/or buffing is secured, and a top surface comprising handle securing means for fixedly securing said block to one end of an elongate handle, wherein said active means comprises a fabric, the different arrangements of the bottom surface of the broom being identical with the base plate features mentioned above. The invention can also be defined as a curling push broom of the above type, wherein said active means comprises a first fabric whose surface defines a generally planar, first active surface, and a second fabric, whose surface defines a second, generally planar active surface vertically spaced from said first surface, said surfaces extending transversely of the bottom surface from one side of the block to the other; said first active surface being normally generally horizontal, said second active surface being disposed at a slight inclination upwards and to one end of the block.

In a particularly preferred embodiment, said generally flat, normally horizontal bottom defines a generally rectangular area having two mutually opposite, relatively short sides and two mutually opposite, relatively long ends, said rectangular area being formed by a first rectangular panel of a deep pile nylon fabric extending full width of said bottom and coincident with one of said ends of the rectangular area; said rectangular area being further formed by a second rectangular panel extending the full width of the bottom and coincident at its one side with the other of said ends of the rectangular area, the other side of said second rectangular panel being coincident with a generally linear joinder between the two panels, said joinder extending generally the entire width of the said rectangular area, the second panel being a non-woven polypropylene fabric whose depth is less than that of the nylon fabric.

According to yet another feature of the present invention, the block is comprised of a base plate whose one surface defines said bottom, an intermediate plate and a top plate, at least some of said plates being made of a plastic material and being held together by fastener means, the plates being of a generally identical contour in plan, whereby, on application of the fastener means, the block is of the type of a laminate comprised of said plates.

BRIEF DESCRIPTION OF THE DRAWINGS

The invention will be described in greater detail by way of a preferred embodiment shown in the accompanying drawings, wherein.

DETAILED DESCRIPTION OF PREFERRED EMBODIMENT

Figure 1:
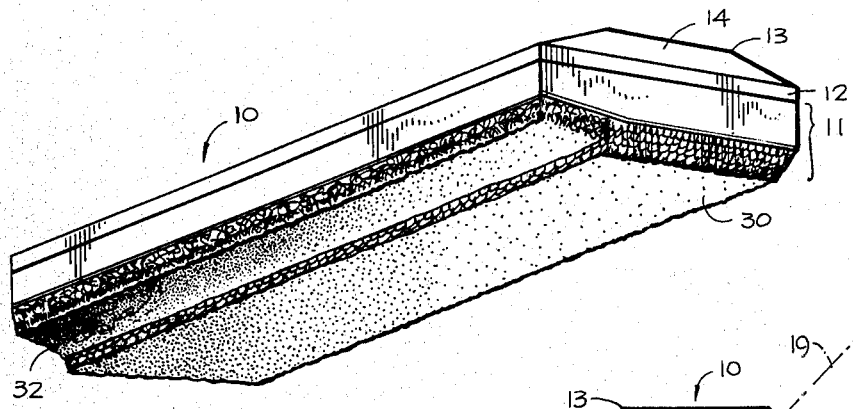
FIG. 1 is a bottom perspective view of the broom with the broom handle not shown for the sake of clarity.

As is well known, any push-type broom generally comprises a solid plate or block with an active bottom surface and a handle fixedly secured to the block. In the drawings, reference numeral 10 designates the block of a rectangular contour in plan. The block is comprised of a bottom or base plate 11, a rectangular intermediate plate 12 and a top plate 13. The surface of the top plate 13 is frusto-pyramidal and displays downwardly and outwardly sloping side surfaces 14, 15 and downwardly sloping front and rear surfaces 16, 17. Disposed centrally of the rear surface is a downwardly and forwardly sloping, generally cylindric opening 18 for fixedly securing to the block 10 a cylindric rod-shaped handle of which only one end 19 is indicated in broken lines in FIG. 2. A pair of countersunk screws 20, 21 pass through a pair of passages 22, 23 in the base plate 11, through passages 24, 25 in the intermediate plate 12 and are threadingly engaged with the top plate 13 at 26, 27.

When the plates 11, 12 and 13 are in assembled state, they form what amounts in effect to a laminate. The handle receiving opening 18 is formed by sectional portions thereof marked 18a, 18b and 18c provided in the plate 13, 12 and 11, respectively.

It has been found that the above arrangement of plates 11, 12 and 13 set together with the fastener screws 20, 21, is of advantage as it enables the manufacture of each of the plates 11, 12 and 13 separately from a suitable plastic material. In a preferred embodiment shown in the drawings, the plate 11 is made of black nylon, plate 12 is a white nylon and plate 13 is a red nylon piece. Those skilled in the art will readily appreciate that even though plates 11, 12 and 13 are shown as simple panels, different protrusions or the like can be provided to reduce the weight and save the plastics material. Such provisions, well known in the art of molding plastics material are no part of the present invention and therefore are not shown.

The bottom surface of the base plate 11 is generally flat and is comprised of two generally planar bottom surfaces 28, 29. Each of the surfaces 28, 29 is of the shape of a rectangular panel. The surfaces are adjacent to each other, the surface 28 being normally generally horizontal (FIG. 2), while the bottom surface 29 near the front end of the block 10 is inclined upwardly and forwardly relative to the surface 28, at an inclination of approximately 7°, also referred to as a "slight" slope or inclination. Adhesively secured to the bottom surface 28 is a deep pile nylon fabric. The fabric used in the preferred embodiment is the fabric used in deep pile nylon carpeting. Experiments have been conducted with different kinds of the fabric to be adhered to the surface 28 and it was found out that 100% nylon fabric is most effective for the purpose of polishing ice during the game of curling. The deep pile of nylon fabric is referred to with reference numeral 30. It defines a lower or bottom active surface 31 which is coincident with a generally horizontal plane A.

Adhesively secured to the second bottom surface 29 is a panel of reversed needle point polypropylene fabric 32 whose lowermost or active surface is coincident with a plane B which is inclined relative to plane A at a slight angle of approximately 7°. It was established by tests that the above kind of polypropylene fabric (well known, for instance, from the art of floor tiles) is exceptionally suitable for buffing the surface of the ice, as opposed to the polishing action by the nylon fabric 30. It was found out that the polypropylene fabric 32, while not damaging the surface of ice, provides a discrete buffing, while the nylon fabric provides an extremely efficient polishing action.

Figure 2:
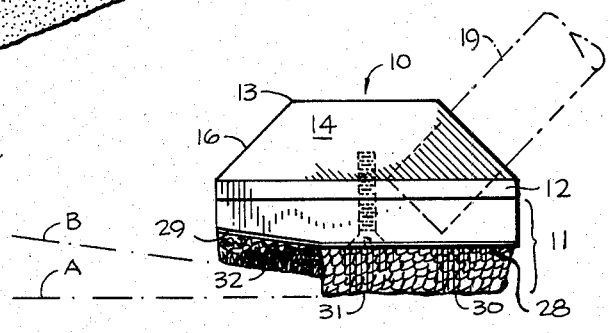
FIG. 2 is a side view of the broom with an indication, in broken lines, of the location of the handle.
Figure 3:
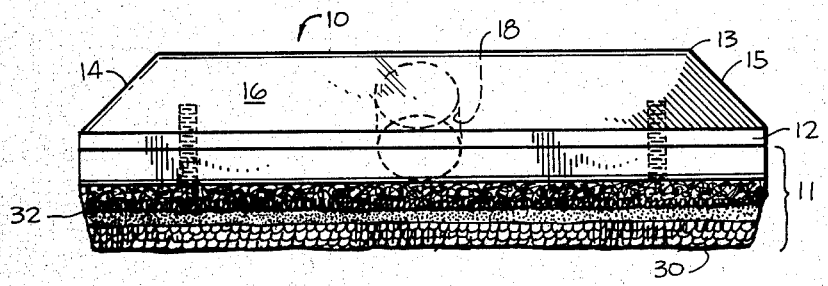
FIG. 3 is one end view of the broom with handle not shown.
Figure 4:
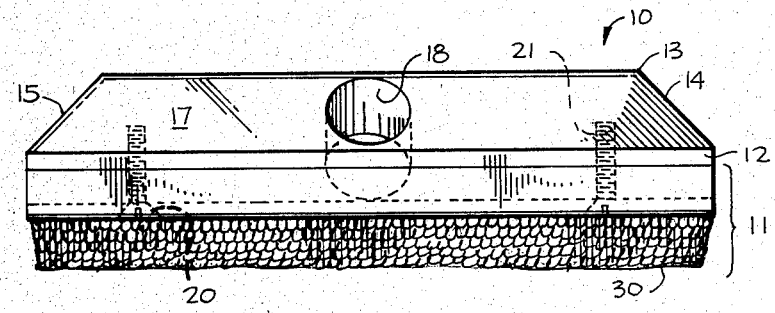
FIG. 4 is another end view thereof with the handle removed.
Figure 5:
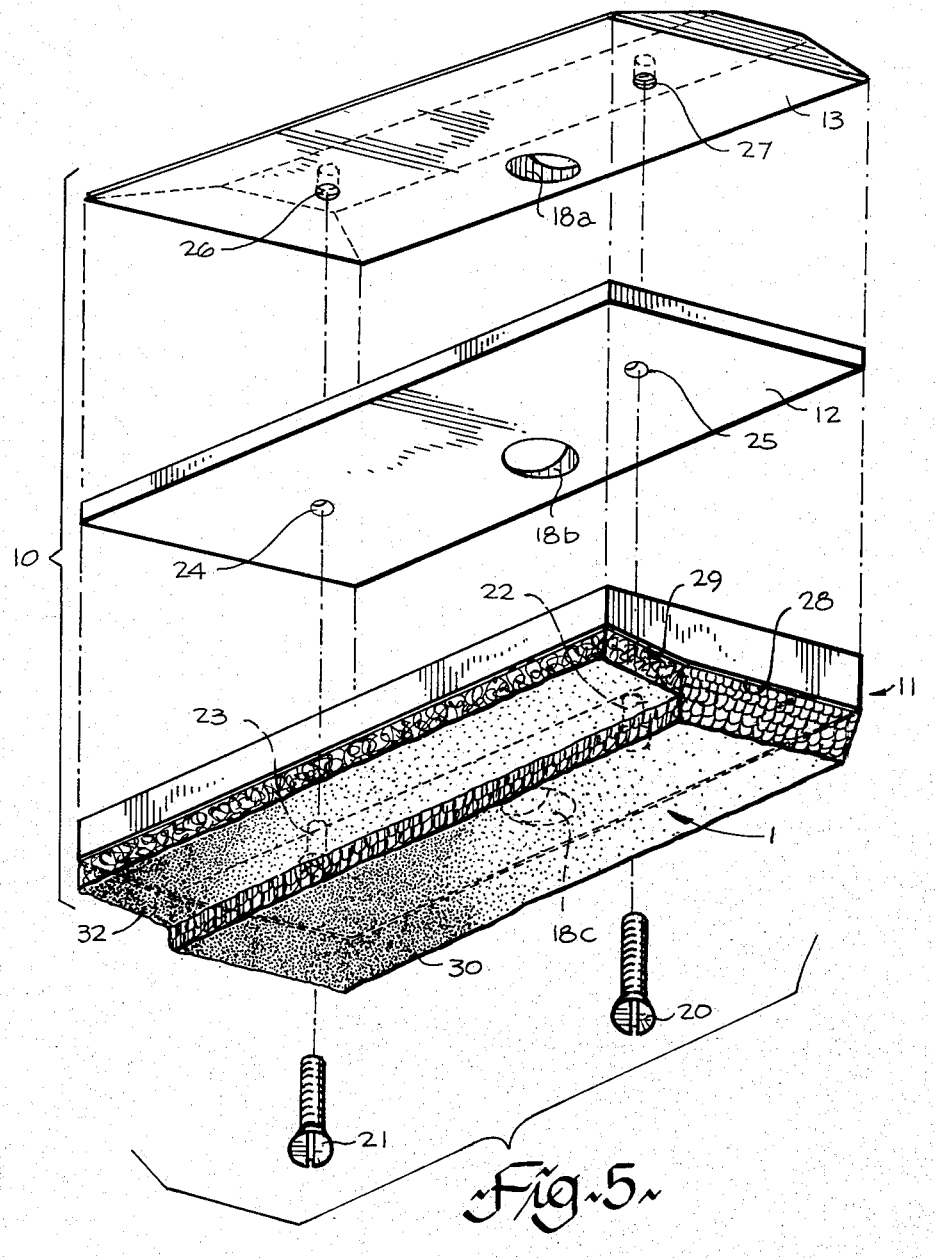
FIG. 5 is an exploded view of the block of the push broom of the present invention.

It is apparent particularly from FIG. 2 that the planes A, B are parallel with the respective surfaces 28, 29 and that, therefore, the planes coincident with surfaces 28, 29 intersect each other generally along a transverse joinder between the two fabrics.

It is also apparent particularly from FIG. 2 but also from FIG. 1 that the planes A and B are vertically spaced from each other. In the preferred embodiment, the spacing is due to the difference in the thickness of the nylon fabric 30 as opposed to the polypropylene fabric 32. Thus, in polishing action, the broom is held generally as shown in FIG. 2. In such position, the plane A is representative of the ice surface. In such position, even though a certain downward pressure will be applied to the broom, causing certain yielding of the nylon fabric 30, the forward polypropylene fabric 32 will still stay spaced above the ice surface. If it is desired to switch from a strictly polishing action to buffing, the player has to tilt the handle 19 as viewed in FIG. 2 counterclockwise thus lowering the front edge of the block to bring the polypropylene fabric 32 into action, while, in such modified position, the nylon fabric 30 is virtually completely out of action. Needless to say, any intermediate degree of polishing as opposed to buffing can be achieved by appropriate angle of tilt of the handle 19.

Apart from the obvious advantage of virtually eliminating any debris falling from the broom, the new curling broom provides an increased versatility. Furthermore, it was found out that the operation life of the new broom is at least three times longer than that of the known bristle brush under the same conditions, not to mention the old classic sweeping brooms whose life span is normally even shorter.

The use of the "laminated" structure provides a further advantage whereby different fabrics can be used at the bottom surface of the base plate 11. Thus, one can readily visualise a series of plates 11 each having a different combination of sweeping fabrics at the bottom. Such plates could then be readily exchanged depending on the instant requirement by the player. The fastener screws 20, 21 are normally driven through the deep nylon fabric 30 and cannot damage ice due to the countersunk arrangement and also due to the thickness of the nylon fabric.

The described embodiment of the present invention is believed to be the best embodiment presently known. This is not to say, however, that further embodiments utilizing one or more of the basic features of the present invention are impossible. For instance, the buffing fabric 32 can be placed to one or the other or both sides of the block instead of the location along the front edge of the bottom surface of the broom. The securement of handle 19 to block 10 can be effected in numerous ways different from the simple opening 18 shown in the preferred embodiment. The block 10, even though preferably made in the "laminated fashion", can, of course, be made from a single block of wood or other material. The bottom surface of the block or of the plate will normally be generally flat which, however, does not mean that it could not be slightly convexly curved to achieve the effect similar to the angular arrangement of the respective surfaces. It has been mentioned before that the combination of nylon fabric and polypropylene fabric as described is deemed best. However, a number of different fabric blends in lieu of the nylon and polypropylene fabrics would still fall within the scope of the invention even though such arrangement would probably be less effective. Another departure from the disclosed embodiment that readily comes to mind would be an arrangement whereby the single combined fabric structure would be substituted by two brooms each having a different fabric at its bottom and thus possessing different polishing and/or buffing properties.

It follows from the above brief review of readily conceivable departures from the preferred embodiment, that the preferred embodiment is to be interpreted as an example of the present invention, there being a great number of modifications many of which, however, do not depart from the scope of the present invention as recited in the accompanying claims.

The embodiments of the invention in which an exclusive property or privilege is claimed are defined as follows:

1. For use in a curling push-broom, a base plate having a bottom surface and a top surface; a fabric covering fixedly secured to the bottom surface and comprising:

(a) a first area whose outside margin is generally coincident with a first end and with a part of each of two opposite sides of said bottom surface;

(b) a second area whose outside margin is generally coincident with a second end opposite to said first end and with remaining parts of each of said two opposite sides of said bottom surface;

(c) said first area being covered by a first fabric, said second area being covered by a second fabric whose coarseness is different from that of said first fabric;

(d) means for securing said base plate to handle means with said bottom surface turned away from the handle means;

whereby a broom utilizing the base plate can be selectively applied for polishing and/or buffing the ice.

2. A base plate as claimed in claim 1, wherein said first fabric is a nylon fabric.

3. A base plate as claimed in claim 2, wherein the nylon fabric is a deep-pile carpet type nylon fabric.

4. A base plate as claimed in claim 1, 2 or 3 wherein the second fabric is a non-woven point polypropylene fabric.

5. A base plate as claimed in claim 1, wherein said first area is a generally planar area coincident with a first plane; said second area being also generally planar and coincident with a second plane, said first and second planes being slightly inclined relative to each other and intersecting each other along a line extending from one of said two opposite sides of the plate to the other, said second plane being inclined forwardly and upwardly from said bottom surface.

6. A base plate as claimed in claim 5, wherein said first area is covered with a nylon fabric and said second area is covered with a non-woven, reversed needle point polypropylene fabric.

7. A base plate as claimed in claim 6, wherein said nylon fabric is a deep-pile carpet type nylon fabric whose surface turned away from the plate is spaced from the plate at a distance greater than the respective spacing of the surface of said polypropylene fabric from said plate.

8. A curling push-broom, comprising, in combination, a base plate having a bottom surface and a top surface; means securing said base plate to handle means with said bottom face turned away from the handle means; a fabric covering fixedly secured to the bottom surface and comprising:

(a) a first area whose outside margin is generally coincident with a first end and with a part of each of two opposite sides of said bottom surface;

(b) a second area whose outside margin is generally coincident with a second end opposite to said first end and with remaining parts of each of said two opposite sides of said bottom surface;

(c) said first area being covered by a first fabric, said second area being covered by a second fabric whose coarseness is different from that of said first fabric;

whereby the broom can be selectively applied for polishing and/or buffing the ice.

9. A broom as claimed in claim 8, wherein said first fabric is a nylon fabric.

10. A broom as claimed in claim 9, wherein the nylon fabric is a deep-pile carpet type nylon fabric.

11. A broom as claimed in claims 8, 9 or 10, wherein the second fabric is a non-woven point polypropylene fabric.

12. A curling push-broom of the type including an elongate block having a generally flat bottom surface to which active means for ice polishing and/or buffing is secured in a generally coplanar relationship, and a top surface comprising handle securing means for fixedly securing said block to one end of an elongate handle, wherein said active means comprises: a deep pile carpet-type nylon first fabric whose surface defines a generally planar, first active surface, and a non-woven polypropylene second fabric, whose surface defines a second, generally planar active surface vertically spaced from said first surface, said surfaces extending tranversely of the bottom surface from one side of the block to the other; said first active surface being normally generally horizontal, said second active surface being disposed at a slight inclination upwards and to one end of the block.

13. A broom as claimed in claim 12 wherein said generally flat, normally horizontal bottom defines a generally rectangular area having two mutually opposite, relatively short sides and two mutually opposite, relatively long ends, said rectangular area being formed by a first rectangular panel of a deep pile nylon fabric extending full width of said bottom and generally coincident with one of said ends of the rectangular area; said rectangular area being further formed by a second rectangular panel extending the full width of the bottom and coincident at its one side with the other of said ends of the rectangular area, the other side of said second rectangular panel being coincident with a generally linear joinder between the two panels, said joinder extending generally the entire length of the said rectangular area, the second panel being a non woven polypropylene fabric whose depth is less than that of the nylon fabric.

14. A broom as claimed in claim 13 wherein said second rectangular panel is coincident with a plane disposed at a slight inclination relative to a horizontal plane, said plane intersecting said normally horizontal bottom along a line generally coincident with said generally linear joinder and being inclined upwards and away from said joinder.

15. A broom as recited in claim 12 or 13 wherein the block is comprised of a base plate whose one surface defines said bottom, an intermediate plate and a top plate, at least some of said plates being made of a plastic material and being held together by fastener means, the plates being of a generally identical contour in plan, whereby, on application of the fastener means, the block is of the type of a laminate comprised of said plates.

16. A broom as recited in claim 14, wherein the block is comprised of a base plate whose one surface defines said bottom, an intermediate plate and a top plate, at least some of said plates being made of a plastic material and being held together by fastener means, the plates being of a generally identical contour in plan, whereby, on application of the fastener means, the block is of the type of a laminate comprised of said plates.

* * * * *